US005284165A

United States Patent [19]

Draghetti

[11] Patent Number: 5,284,165

[45] Date of Patent: Feb. 8, 1994

[54] STATISTICAL VENTILATION CONTROL DEVICE FOR VENTILATED CIGARETTES

[75] Inventor: Fiorenzo Draghetti, Medicina, Italy

[73] Assignee: G.D Societa' Per Azioni, Bologna, Italy

[21] Appl. No.: 949,773

[22] Filed: Sep. 21, 1992

[30] Foreign Application Priority Data

Sep. 25, 1991 [IT] Italy ..... B091 A000343

[51] Int. Cl.[5] ..... A24C 5/34

[52] U.S. Cl. ..... 131/281; 131/904; 131/908; 209/535

[58] Field of Search ..... 131/280, 281, 904, 905, 131/908, 907, 910; 73/38, 40; 209/535, 537, 539

[56] References Cited

U.S. PATENT DOCUMENTS 3,237,444 3/1966 Kaeding et al. ..... 131/904 X 4,531,629 7/1985 Seragnoli et al. ..... 131/281 X

FOREIGN PATENT DOCUMENTS 2147490 5/1985 United Kingdom .

2183136 6/1987 United Kingdom ..... 131/908

*Primary Examiner*—Mark S. Graham

*Assistant Examiner*—J. Doyle

*Attorney, Agent, or Firm*—Marshall, O'Toole, Gerstein, Murray & Borun

[57] ABSTRACT

A statistical ventilation control device for ventilated cigarettes, wherein an annular conveyor presents a number of seats, each receiving a respective ventilated cigarette arranged perpendicular to the traveling direction of the conveyor; one of the aforementioned seats being a movable seat supported on a slide fitted to the conveyor so as to move the movable seat axially in relation to the conveyor and to and from an operating position wherein a ventilated portion of the cigarette engages a ventilation control unit fitted to and moving with the conveyor.

6 Claims, 4 Drawing Sheets

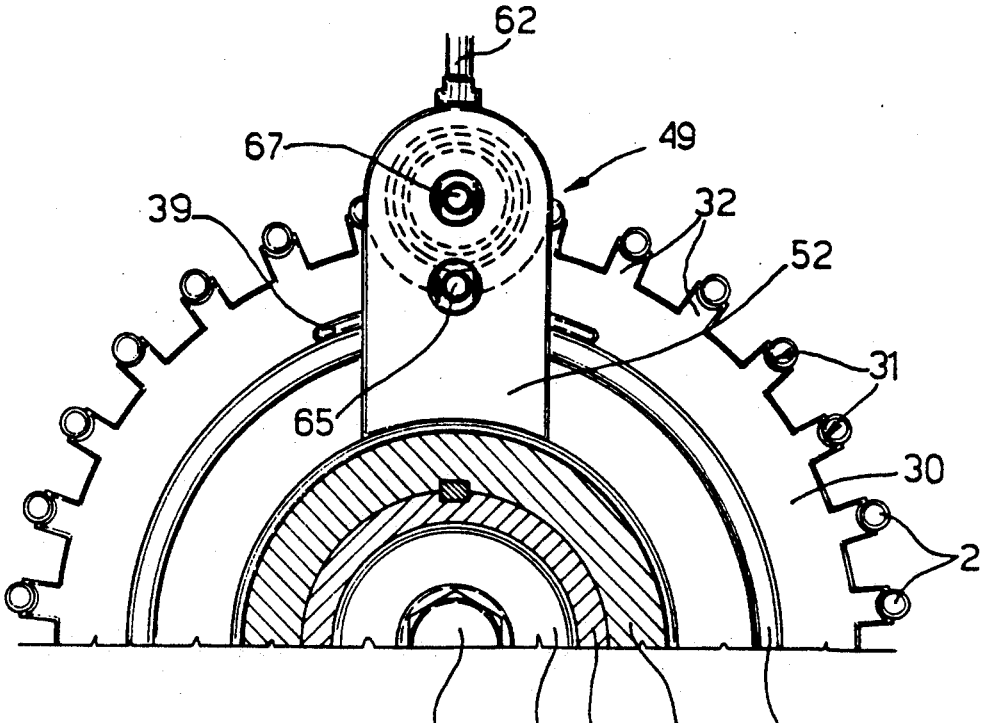
Fig.3
Fig. 4
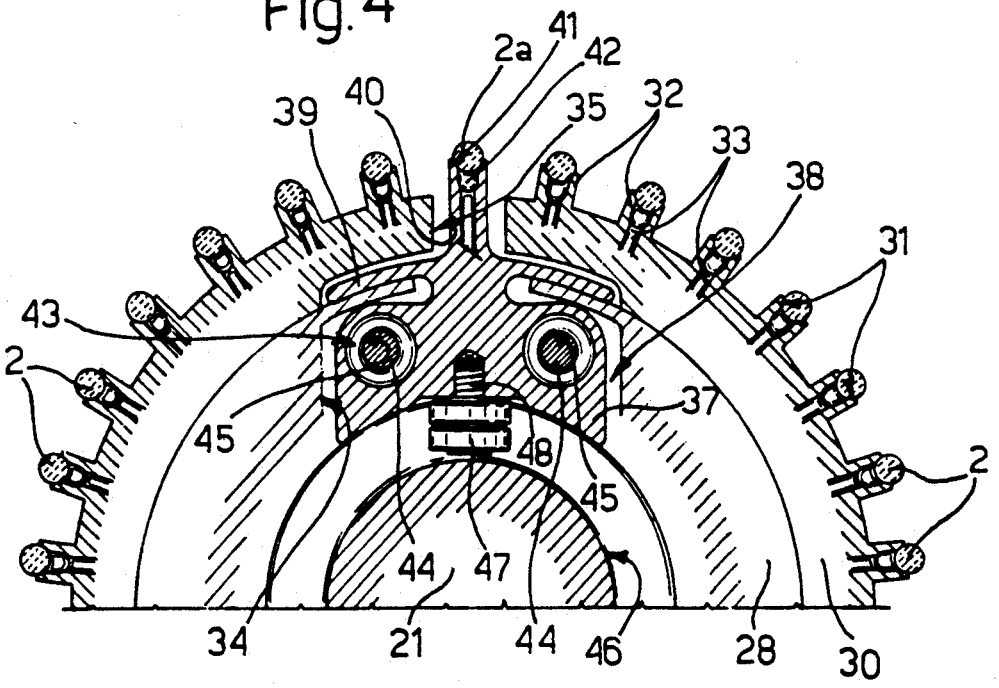

STATISTICAL VENTILATION CONTROL DEVICE FOR VENTILATED CIGARETTES

BACKGROUND OF THE INVENTION

The present invention relates to a statistical ventilation control device for ventilated cigarettes.

Ventilated cigarettes normally consist of a filter-tip cigarette, the cover band of the filter of which presents ventilation holes formed by means of perforating devices, for enabling the smoker to inhale, together with the smoke produced by combustion of the tobacco, a certain amount of air for reducing both the temperature and the amount of harmful substances contained in the smoke.

During manufacture, ventilated cigarettes are normally subjected to constant hundred percent control to determine "ventilation" performance and so enable rejection of any poorly ventilated cigarettes as well as continuous adjustment of the perforating devices.

In actual practice, however, hundred percent control has proved not only relatively expensive and, in view of the limited time available, invariably unreliable, but also substantially superfluous, by virtue of any change in ventilation performance occurring in the form of "tendencies" as opposed to random, sharp variations. As such, statistical ventilation control (e.g. one out of every thirty cigarettes) has been found to be no less effective than hundred percent control, and is decidedly cheaper and more reliable by virtue of the smaller number of cigarettes involved and, hence, the additional time available for control.

SUMMARY OF THE INVENTION

It is an object of the present invention to provide a device enabling statistical ventilation control of ventilated cigarettes.

According to the present invention, there is provided a statistical ventilation control device for ventilated cigarettes, each having a ventilated portion with lateral ventilation holes; characterized by the fact that it comprises an annular conveyor; a number of seats on the conveyor, arranged side by side and perpendicular to the traveling direction of the conveyor, said seats being each designed to receive a respective cigarette, and comprising a number of seats fixed in relation to the conveyor and at least one seat moving axially in relation to the conveyor; movable supporting means located between said movable seat and the conveyor; a unit for controlling the ventilation, through said ventilation holes, of a cigarette housed inside said movable seat, said control unit moving with said conveyor in said traveling direction, and facing an axial end of said movable seat; and actuating means for moving said movable supporting means to and from an operating position wherein the ventilated portion of said cigarette housed inside said movable seat engages said control unit.

Said movable supporting means preferably comprise a slide fitted with said movable seat and mounted on the conveyor so as to slide, in a direction perpendicular to said traveling direction, between said operating position and an idle position wherein said movable seat is aligned transversely with said fixed seats.

At each turn of the annular conveyor, therefore, at least one cigarette engages the control unit, which, by the time the cigarette is restored to the idle position on the conveyor, is allowed relatively ample time for determining the efficiency of the ventilation holes and, if necessary, regulating the perforating devices upstream from the annular conveyor.

BRIEF DESCRIPTION OF THE DRAWINGS

A preferred, non-limiting embodiment of the present invention will be described by way of example with reference to the accompanying drawings, in which:

FIG. 3 shows a schematic section along line III—III in FIG. 2;

FIG. 4 shows a schematic section along line IV—IV in FIG. 2;

DETAILED DESCRIPTION OF THE INVENTION

Figure 1:
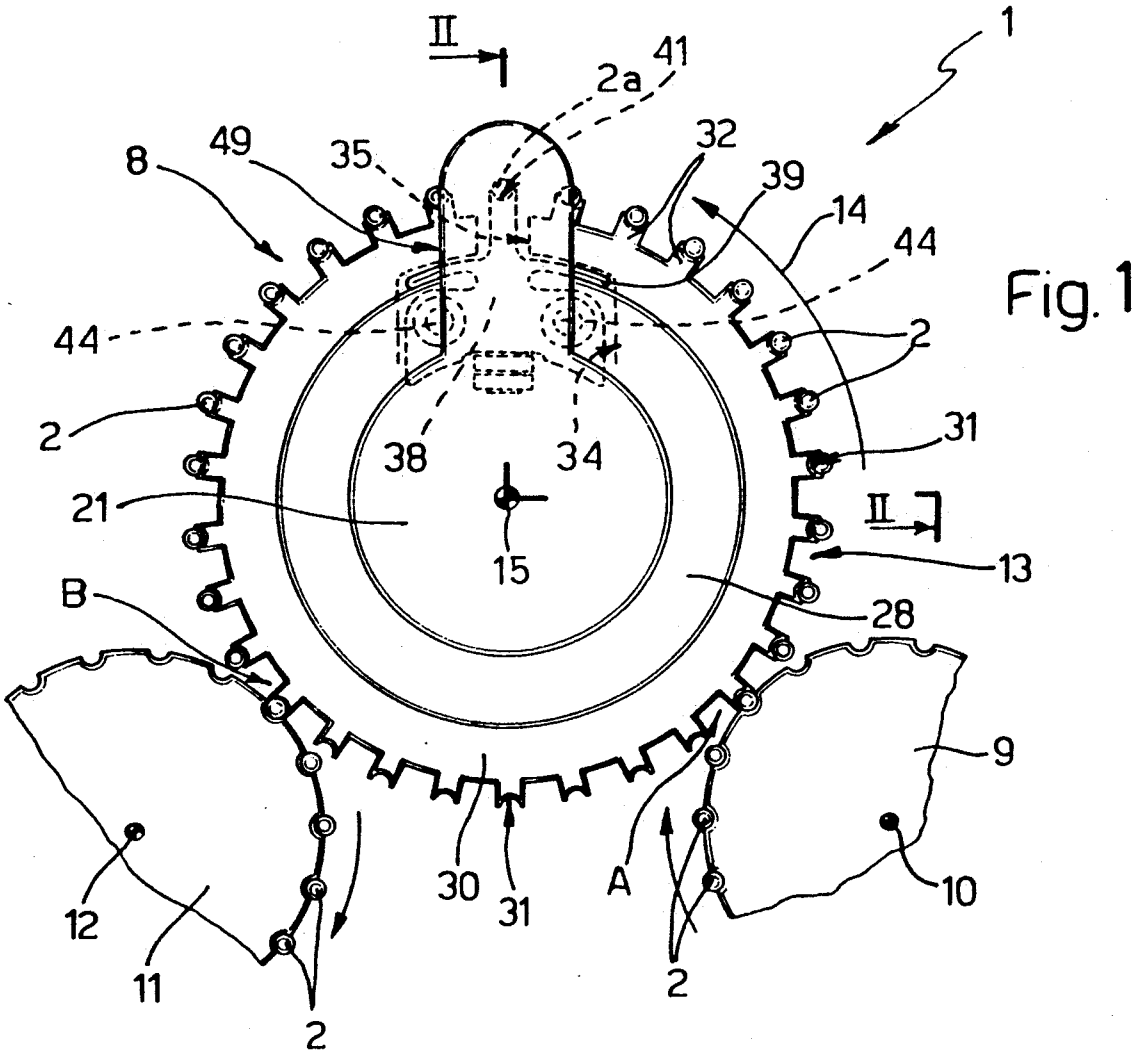
FIG. 1 shows a schematic side view, with parts removed for simplicity, of a portion of a filter assembly machine comprising a ventilation control device in accordance with the teachings of the present invention.

Number 1 in FIG. 1 indicates a filter assembly machine for producing cigarettes 2, each comprising a filter 3 (FIGS. 5 and 6) having a ventilated portion 4 defined, in the example shown, by two rings 5 of substantially radial holes 6 formed through the cover band 7 of filter 3.

Machine 1 comprises a device 8 for controlling the ventilation of cigarettes 2, and defined by an input conveyor roller 9 rotating clockwise (in FIG. 1) about axis 10; an output conveyor roller 11 rotating clockwise (in FIG. 1) about axis 12; and an intermediate conveyor roller 13 rotating in anticlockwise direction 14 (in FIG. 1) about axis 15 parallel to axes 10 and 12, and tangent to rollers 9 and 11 at respective cigarette loading and unloading stations A and B.

Figure 2:
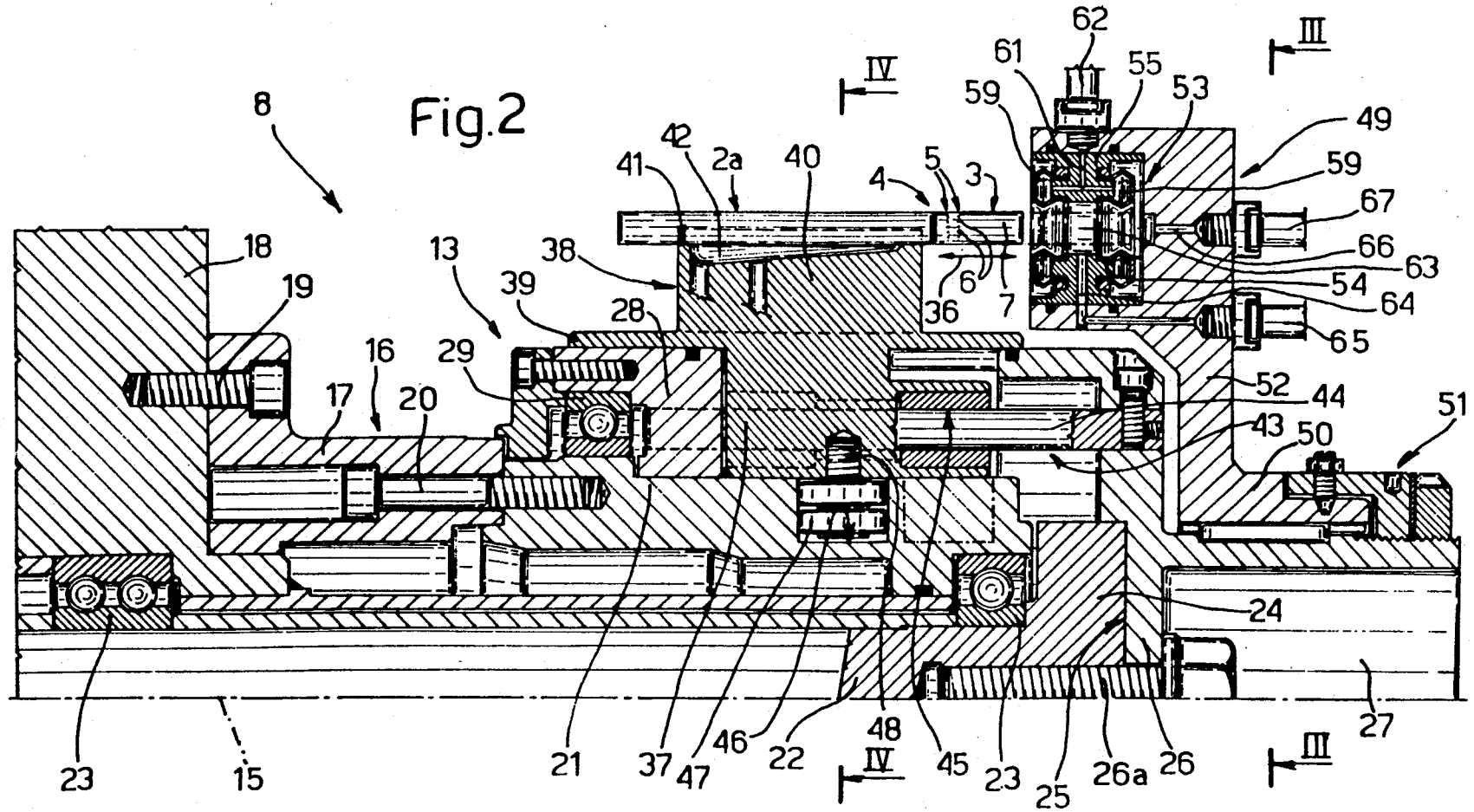
FIG. 2 shows a section along line II—II in FIG. 1.

As shown in FIG. 2, roller 13 presents a tubular support 16 coaxial with axis 15 and comprising a tubular body 17 having a first flanged end connected integral with a supporting wall 18 by screws 19, and a second end connected, by screws 20, integral with one end of a tubular drum cam 21 coaxial with axis 15 and forming part of tubular support 16.

Wall 18 and tubular support 16 are fitted through with a drive shaft 22 connected for rotation to wall 18 and support 16 via the interposition of bearings 23, and having, on the end projecting from the free end of cam 21, a cylindrical head 24 engaging a cylindrical axial recess 25 in a plate 26 coaxial with axis 15 and connected integral with head 24 by means of a central axial screw 26*a*.

Plate 26 presents, on one side, a tubular appendix 27 coaxial with axis 15 and projecting from the opposite surface of plate 26 to that with recess 25; and, on the other, a cylindrical tubular body 28 coaxial with axis 15, extending outwards of cam 21, and connected for rotation to the outer surface of cam 21 via the interposition of a bearing 29.

As shown in FIGS. 3 and 4, tubular body 28 is fitted with a sleeve 30, the outer surface of which presents a number of equally-spaced seats 31, hereinafter referred to as "fixed seats", each formed along the end of a respective axial rib 32 integral with sleeve 30, and having a suction device 33 for retaining a respective cigarette 2. As roller 13 is rotated in direction 14 about axis 15 by the torque transmitted by drive shaft 22, each fixed seat 31 receives a respective cigarette 2 from input roller 9 at loading station A, and feeds it over arc A-B and on to roller 11 at unloading station B.

As shown particularly in FIG. 4, tubular body 28 presents a radial through opening 34 facing a longitudinal recess 35 formed through sleeve 30.

As shown in FIG. 2, in which sleeve 30 is omitted for the sake of simplicity, opening 34 is engaged in sliding manner, in direction 36 parallel to axis 15 and perpendicular to direction 14, by the foot 37 of a slide 38, which comprises an intermediate flange 39 cooperating in sliding manner with an outer surface portion of tubular body 28 surrounding opening 34; and a head 40 engaging recess 35 in sliding manner (FIG. 4), and the free end of which presents a seat 41, hereinafter referred to as the "movable seat", located between two fixed seats 31. Movable seat 41 presents a respective suction device 42, similar to devices 33, for retaining a respective cigarette 2, hereinafter referred to as cigarette 2a, and is located parallel to and the same distance from axis 15 as seats 31.

Slide 38 slides inside opening 34 in direction 36 and along a slideway 43 defined by two rods 44 fitted to tubular body 28 and extending along opening 34 in direction 36 so as to engage in sliding manner respective through holes 45 formed in foot 37 of slide 38. The movement of slide 38 along slideway 43 is controlled by cam 21, which presents an outer annular groove 46 engaged by a tappet roller 47 supported on a pin 48 projecting radially from the inner end of foot 37.

As shown more clearly in FIG. 2, device 8 comprises a unit 49 for controlling the ventilation of cigarette 2a, i.e. instantaneous air flow through holes 6 in ventilated portion 4 of cigarette 2a, when portion 4 is subjected directly and externally to a given vacuum.

Unit 49 comprises a sleeve 50 fitted and locked axially to appendix 27 by a ring nut clamping device 51; an appendix 52 extending radially outwards from the end of sleeve 50 facing plate 26; and a suction and control device 53 housed inside a cavity 54 formed on appendix 52 and facing the end of movable seat 41.

Figure 5:
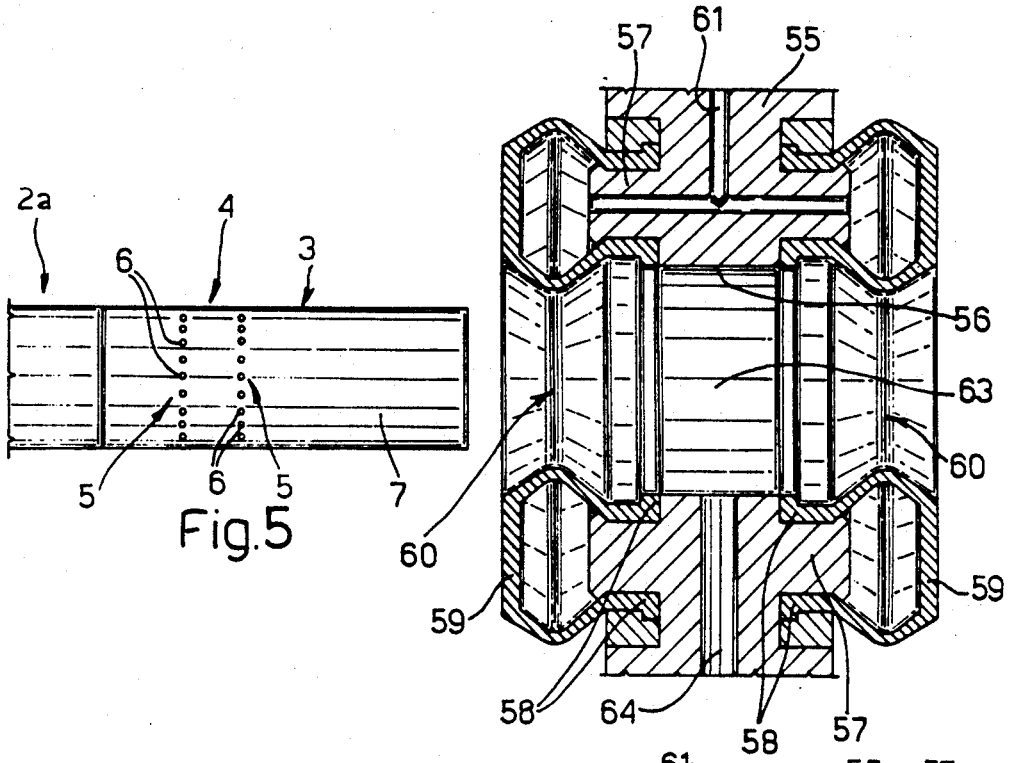
FIGS. 5 and 6 show enlarged views of a detail in FIG. 2 in two different operating positions.
Figure 6:
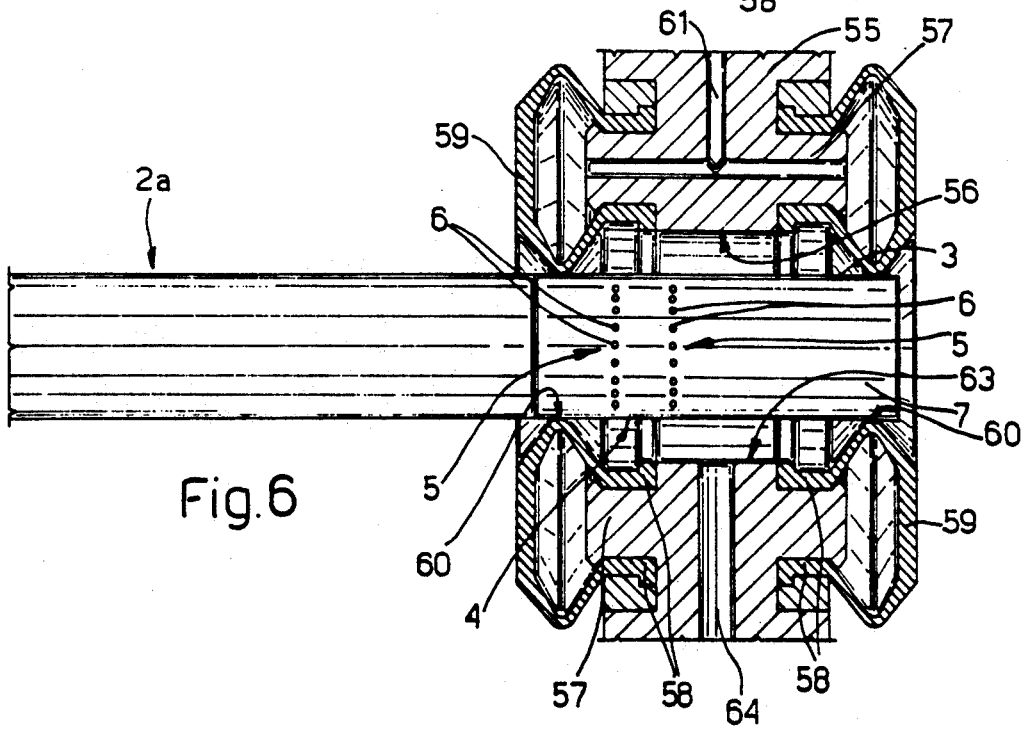

As shown more clearly in FIGS. 5 and 6, device 53 comprises a ring 55 fitted inside cavity 54, coaxial with movable seat 41, and having an axial through hole 56 and two opposite annular end ribs 57. Each rib 57 is fitted in fluidtight manner with the opposite lips 58 of a respective bellows type annular air chamber 59 coaxial with ring 55 and having a deformable inner annular edge 60 coaxial with hole 56. Via holes 61 formed in ring 55, air chambers 59 communicate with a suction device 62 (FIG. 2), operation of which provides for axially depressing air chambers 59 and flexibly reducing the diameter of edges 60 from a first (FIG. 5) to a second diameter respectively greater and smaller than the diameter of cigarette 2a.

As shown in FIGS. 5 and 6, air chambers 59 and ring 55 define, between edges 60, a control chamber 63 communicating, via a radial hole 64 in ring 55, with a suction device 65 (FIG. 2) and engaged by a portion of cigarette 2a, in this case, filter 3 with ventilated portion 4. For this purpose, groove 46 of cam 21 is so formed as to move slide 38 from an idle position (FIGS. 2 and 5) wherein ventilated portion 4 of cigarette 2a is located outside chamber 63 and movable seat 41 is aligned transversely with fixed seats 31, to an operating position wherein ventilated portion 4 of cigarette 2a engages chamber 63.

Finally, as shown in FIG. 2, cavity 54 communicates, via an axial hole 66 formed through appendix 52, with a further (optional) suction device 67, for measuring the permeability of cigarette 2.

In actual use, at each passage through loading station A, movable seat 41 receives a cigarette 2a from roller 9, which it feeds over arc A-B on to roller 11 at unloading station B. Groove 46 is so formed as to maintain slide 38 in the idle position as it travels through station A and B and over arc B-A, and in the operating position as it travels over substantially the whole of arc A-B. Consequently, once past station A, slide 38 moves in direction 36 into the operating position, so that filter 3 of cigarette 2a engages chamber 63, and ventilated portion 4 of cigarette 2a is positioned between annular edges 60 of air chambers 59. When the air in chambers 59 is removed by suction device 62, chambers 59 mate in fluidtight manner with filter 3 along respective edges 60, and chamber 63 is closed.

Operation of suction device 65 at this point provides for drawing in outside air solely through ventilation holes 6, which air is fed by suction device 65 to a known control device (not shown) for measuring the air flow through holes 6 when subjected by device 65 to a given vacuum. The resulting air flow values are compared in known manner with correct values, for generating, if necessary and in known manner, error signals for adjusting known perforating devices (not shown) by which holes 6 are formed.

The time available for measuring air flow through holes 6 is therefore substantially equal to the time taken by seat 41 to travel over arc A-B, which is thus sufficient for enabling extremely accurate measurements using only one control unit 49.

Obviously, for a given number of seats 31 on roller 13, the frequency of the statistical control as described above may be increased by fitting roller 13 with two or more units 49 and respective slides 38.

I claim:

1. A statistical ventilation monitoring device comprising:

an annular conveyor having a plurality of seats thereon, adapted to receive a ventilated cigarette therein, which move with said conveyor along an annular path, said seats including a plurality of fixed seats fixed relative to said conveyor and at least one movable seat movable in a direction perpendicular to said annular path;

ventilation control means for monitoring the ventilation of a cigarette received in said at least one movable seat, said ventilation control means moving with said conveyor along said annular path;

a movable supporting means between said conveyor and said movable seat for supporting said movable seat; and actuating means for moving said movable supporting means in said perpendicular direction into and out of an operating position in which a cigarette received in said movable seat engages said ventilation control means.

2. A device as claimed in claim 1, wherein said movable supporting means comprise a slide supporting said movable seat and mounted on the conveyor so as to slide in a direction, perpendicular to said traveling direction, between said operating position and an idle position wherein said movable seat is aligned transversely with the fixed seats.

3. A device as claimed in claim 1, wherein said conveyor comprises a drum mounted for rotation about its axis in said traveling direction.

4. A device as claimed in claim 3, wherein said actuating means comprise cam means connected to said movable supporting means for moving said supporting means to and from said operating position at each complete turn of said annular conveyor.

5. A device as claimed in claim 1, wherein said ventilation control means comprises a chamber means; closing means fitted to said chamber means and adapted to mate with a cigarette received in said movable seat for rendering said chamber means fluid-tight about the cigarette; and suction means for removing air from said chamber means.

6. A device as claimed in claim 5, wherein said chamber means comprise a ring, and said closing means comprise two bellows type annular air chambers on either side of and supported on said ring; each said air chamber being coaxial with said ring and having an inner annular edge having a given diameter and adapted to mate in fluidtight manner with the outer surface of a cigarette received in said movable seat; further suction means (62) being connected to said air chambers for reducing the diameter of said inner annular edges from a first to a second diameter respectively greater and smaller than the diameter of the cigarette.

* * * * *